United States Patent [19]

Baitinger et al.

[11] Patent Number: 4,632,022

[45] Date of Patent: Dec. 30, 1986

[54] FUME HOOD FABRICATED FROM MODULES AND HAVING LATERALLY EXTENDING EXHAUST PORTS

[75] Inventors: William E. Baitinger, West Lafayette, Ind.; G. Thomas Saunders, Geneva, Ill.

[73] Assignee: St. Charles Manufacturing Co., St. Charles, Ill.

[21] Appl. No.: 705,072

[22] Filed: Feb. 25, 1985

[51] Int. Cl.[4] ..... B08B 15/02

[52] U.S. Cl. ..... 98/115.3; 312/209; 312/257 R

[58] Field of Search ..... 98/115.3; 312/107, 209, 312/223, 257 R, 263; 55/DIG. 10; 52/79.4, 236.2

[56] References Cited

U.S. PATENT DOCUMENTS

| | | | |
|---|---|---|---|
| 2,701,746 | 2/1955 | Piggott | 312/257 R X |
| 3,041,957 | 7/1962 | Liptay | 98/115.3 |
| 3,049,069 | 8/1962 | Whiston et al. | 98/115.3 |
| 3,724,142 | 4/1973 | Worthington | 52/79.4 X |
| 3,941,040 | 3/1976 | Carlson | 98/115.3 |
| 4,059,903 | 11/1977 | Piet et al. | 98/115.3 |

FOREIGN PATENT DOCUMENTS

| | | | |
|---|---|---|---|
| 1009495 | 5/1977 | Canada | 98/115.3 |
| 1518818 | 2/1968 | France | 52/79.4 |
| 2,422,363 | 12/1979 | France | 312/263 |
| 2019212 | 10/1979 | United Kingdom | 312/257 R |

*Primary Examiner*—Harold Joyce

*Attorney, Agent, or Firm*—Robert E. Wagner; Ralph R. Rath

[57] ABSTRACT

A fume hood is fabricated of three or four like modules to a desired partial or full cylindrical structure having a reaction chamber therein. Each module has an upstanding, arcuate circumferential outer wall and an upper wall and base extending inwardly therefrom in coincidence above and below one another. The top wall and base have the shape of a sector of a circle with their apexes opposite the outer wall and the outer wall being the arc of the sector. An inner wall spaced interior of the outer wall defines an exhaust passageway therebetween with movement of gases and air being through exhaust ports through the inner wall. The exhaust ports are spaced apart between the top wall and base and are at constant certain distances from the top wall and base.

18 Claims, 6 Drawing Figures

C
81C
80C
78
76C
16C
72C
72C
64C
72C
66C
60C
68C
20C
82C
26
22
18C
84C

B
16B
38B
71
32A
16A
A
76A
72A
74A
80B
74B
68B
72B
76B
32B
71
38C
16C
C
72C
76C
74C
32C
80C
68C
28B
34C
P2B
P1C
18C
84C
P2C
28C
24
73C
23C
75
19
23B
84B
18B
73B
21
5
5
P1B
34B
23A
73A
84A
P1A
34A
26
28A
P2A
18A
80A
68A
38A

FUME HOOD FABRICATED FROM MODULES AND HAVING LATERALLY EXTENDING EXHAUST PORTS

DESCRIPTION

TECHNICAL FIELD OF THE INVENTION

This invention relates generally to fume hoods that safely exhaust undesired reaction gases, vapors and other hazardous materials from an enclosed chamber, and in particular, relates to a fume hood fabricated of like modules, each having laterally extending exhaust ports distributed vertically of the chamber, the hood adapted for use with a centrally installed circular access robotic arm.

BACKGROUND PRIOR ART

Fume hoods are well known in school and research laboratories to safely exhaust undesired reaction gases, vapors and other hazardous materials produced by chemical reactions effected within the reaction chamber. Herein, the reaction gases, vapors and other hazardous materials will be referred to collectively as "reaction gases". The necessary reagents and reactor vessels are placed in the chamber and the desired reactions occur manually as the reagents are mixed, etc. Gases produced by the reactions that are harmful and not needed in further reactions escape into the chamber to be exhausted therefrom together with the chamber ambient air by such as an exhaust fan through an opening at the back or top of the chamber. Fresh air enters the chamber through the front access opening by which the reactions manually are effected. Duct means external the fume hood conduct the exhausted gases and air for safe venting to the atmosphere or other equipment.

Previous fume hoods have been individually constructed and arranged for particular applications and have generally been designed for installation as a fixture in a laboratory room. For example, see U.S. Pat. No. 3,941,040 providing a special polygonal structure for a classroom environment in which a teacher supervises two students conducting chemical reactions in the same fume hood. The structure disclosed in that patent presents three openings for manual access that are tangentially arranged around a central mounting post that includes exhaust openings for removing the undesired reaction gases.

Typical prior fume hoods have rectangular work areas arranged to be in front of the student or research experimenter. This rectangular work area has a short depth in front of the experimenter and a sometimes more than ample width laterally of the experimenter. Typically, the depth is two feet and the width can be four to eight feet. This rectangular work area shape is believed to be inefficient use of space because of the limited depth in front of the experimenter and the experimenter having to reach or walk laterally to the extent of the width of the hood.

A minimum average linear rate of air movement through the access opening into the chamber must be maintained to guarantee confinement of the undesired gases in the fume hood chamber. A lesser rate of air movement can allow the gases to leak out through the access opening. The large openings of the prior fume hoods required large fans and motors moving large quantities of gases and air to obtain the minimum linear rate of air movement, which requires excessive energy and is noisy. A new fume hood desirable should move lesser quantities of gases and air while insuring proper fume hood gas retention.

Recently, robotic mechanisms that include a radially extending arm extending from a central pedestal or platform are being used in conducting chemical reactions in an enclosed fume hood environment. This presents new requirements for fume hoods. For example, where the reactions to be affected are particularly dangerous to humans, the fume hood should completely enclose the reaction chamber; the robotic mechanisms have substantially a circular reach around the pedestal and therefore the working area in the fume hood should be substantially circular; the fume hood should be readily configured of standard components to reduce the cost of designing and installing custom fume hood structures; and connection of the fume hood to external duct work for exhausting undesired reaction gases should be readily implemented.

SUMMARY OF THE INVENTION

In accordance with the invention, a fume hood is fabricated of a plurality of like modules arranged next to one another with their marginal or peripheral exposed surfaces in abutment. Brackets bind the modules together in a permanent structure. The modules can form either a partial or full cylindrical structure having a hollow or chamber therein in which the undesired gas producing chemical reactions can occur and in which the robotic mechanism can be installed.

Each module has three sides that form a top wall, an outer wall and a base, the top wall and base being arranged aligned or coincident above and below one another and that are interconnected along like margins by the upstanding circumferential outer wall. Both the top wall and base extend inwardly from the outer wall.

The top wall and base each have an apex formed by the juncture of their two exterior surfaces opposite the outer wall. The exterior surfaces of the top wall and base and of the outer wall define two planes intersecting at the apexes. In the preferred embodiment, the top wall and base both have the shape of a sector of a circle, with the juncture of the apex being the center of the circle, the exposed surfaces of the top wall and base being the radii of the circle and the outer wall being arcuate to be the arc of the sector. This results in a chamber that is substantially cylindrical interior of the joined modules. Further, the base includes a removable, square block centered at what would otherwise be the apexes of the base.

In accordance with the invention there also is provided an exhaust structure interior of each module that removes the undesired gases and air from the chamber at several locations spaced apart between the base and top wall. These plurality of exhaust ports or locations reduce the turbulence of air in the chamber.

The exhaust structure includes an inner wall extending the width of the circumferential outer wall and spaced therefrom by spacers to form a gas and air exhausting passageway therebetween. The inner wall extends substantially from the top wall to the base. The inner wall has therein several, three in the preferred embodiment, through exhaust ports. The exhaust ports, in the preferred embodiment, are substantially rectilinear slots through the inner wall at certain, constant distances from the base and top wall, one being adjacent the base, one adjacent the top wall and one centrally located therebetween.

The exhaust ports facilitate communication or movement of gases and air from the chamber to the passageway from which they can be removed by a fan-motor combination contained in the module or preferably remote from the fume hood. The remote fan-motor combination can be coupled to the fume hood by a flexible duct.

It is believed that a fume hood having a circular work area and in which the experimenter is substantially centrally located in the hood, such as in a wedge cut out of the circular work space, will be more efficient. The experimenter, even sitting in a chair in front of such a fume hood, has easy reach to the entire work area of the fume hood circumferentially of his or her position. A rectangular fume hood can require the experimenter to walk back and forth across the front thereof.

Further, a circular fume hood with a one quarter wedge cut out is more work area to required floor area efficient than a rectangular work area fume hood. The experimenter can stand or sit in the area of the wedge cut out of the circular fume hood while an experimenter must have a foot or more of access across the entire front of the rectangular fume hood.

Other advantages and features of the invention will become apparent upon making reference to the specification, claims, and drawings to follow.

DESCRIPTION OF THE PREFERRED EMBODIMENT

Figures 1, 2, 3, 6:
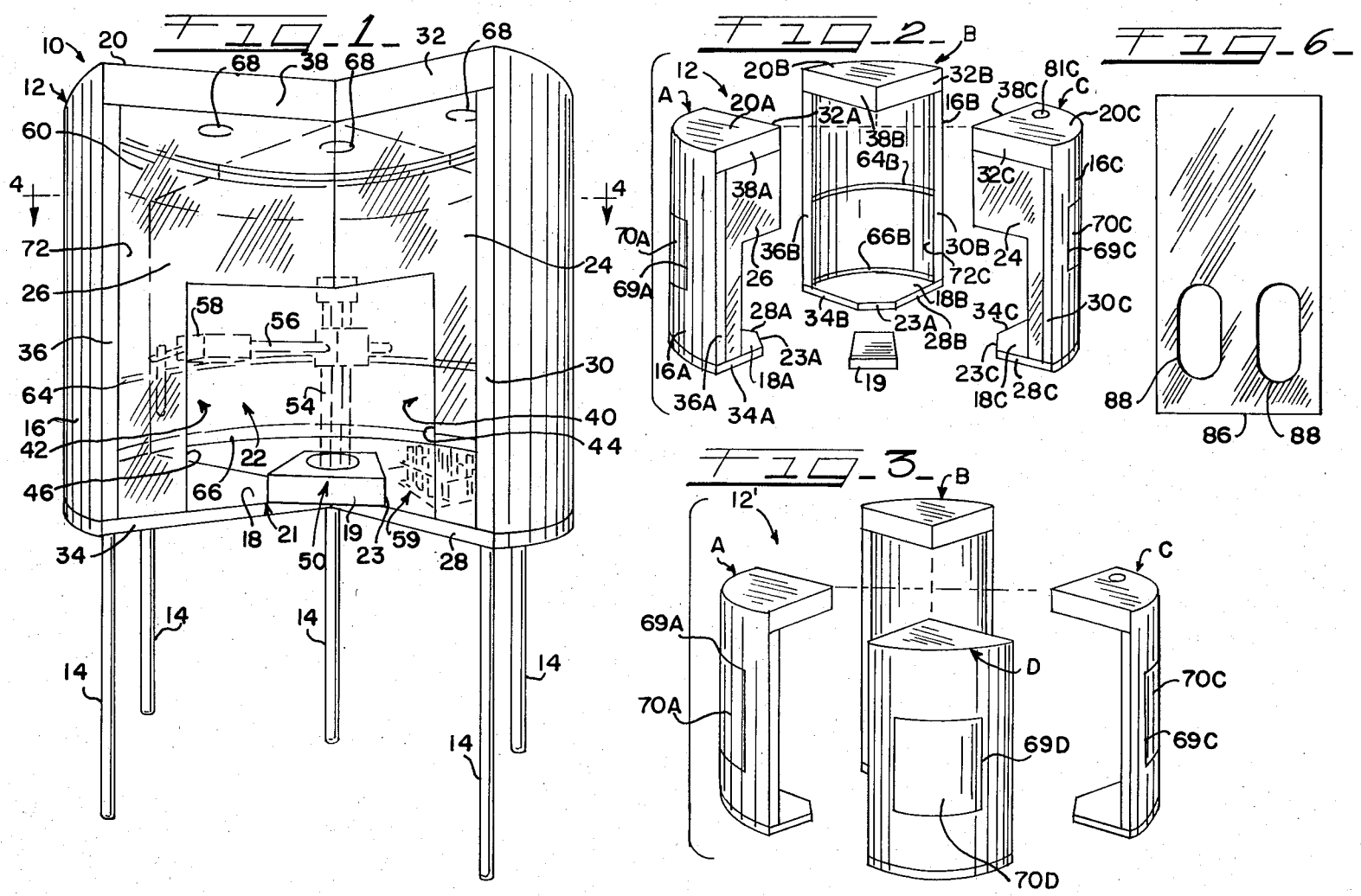
FIG. 1 is a perspective view of a fume hood constructed and arranged in accordance with the invention.
FIG. 2 is an exploded perspective view of three modules normally joined in abutment to form the fume hood of FIG. 1.
FIG. 3 is an exploded perspective view of four modules normally joined in abutment to form an alternate embodiment fume hood according to the invention.
FIG. 6 is a front elevation of an alternative front panel used with the fume hood of the invention.

In FIG. 1, fume hood 10 comprises an enclosure 12 supported by five depending legs 14. Alternatively, enclosure 12 can be supported by a cabinet or other structure as desired, and enclosure 12 can be mounted on a lower structure having casters for ease of moving the fume hood 10.

Enclosure 12 comprises a circumferential, upstanding outer wall 16, a flat base 18, a base block 19 and a top wall 20 defining an enclosed chamber 22 that extends around substantially three-quarters of a circle.

Base block 19 is installed in an opening 21 in base 18 defined by a substantially square, depending surface 23 therein and mating with base block 19. Base block 19 is a substantially rectangular or square solid body removably mounted in base 18.

Circumferential wall 16 terminates in two opposed, exposed surfaces 30 and 36. Top wall 20 has two exposed surfaces 32 and 38 and base 18 has two exposed surfaces 28 and 34. Surfaces 28, 30 and 32 substantially define a plane passing through the center of the enclosure. Surfaces 34, 36 and 38 also substantially define a plane passing through the center of the enclosure, there being an angle of substantially ninety degrees between the two planes, which are further discussed hereinafter.

Chamber 22 substantially is closed by front panels 24 and 26, which are transparent, to enable viewing of the interior of chamber 22. Front panel 24 is attached by a hinge or hinges (not shown) to exposed surface 30 of wall 16. Front panel 26 is attached by a hinge or hinges (not shown) to exposed surface 36 of wall 16. Front panels 24 and 26 respectively have rectangular access openings 40 and 42 therein defined by respective peripheral edges 44 and 46 to provide access to chamber 22 by a student or research experimenter.

The enclosure 12 can be described to be a hollow, cylindrical structure having a wedge cut therefrom for access into chamber 22. Circumferential wall 16 extends in width substantially around the two lateral sides and the back of enclosure 12, leaving the front open, to be covered by front panels 24 and 26. In this regard, enclosure 12 is substantially a box open only to the front.

Enclosure 12 is adapted to receive and contain in chamber 22 a robotic mechanism 50 (shown in dashed line outline) comprising upstanding shafts 54, arm 56 and grasping mechanism 58 mounted on base block 19. Robotic mechanism 50 operates to combine desired reagents in selected reactor vessels, such as test tubes 59 also shown in dashed line outline, to effect desired chemical reactions under such as computer control and without manual intervention.

Mechanism 50 and test tubes 59 are manually installed and placed in chamber 22 resting respectively on the top surface of base block 19 and base 18. The computer controller is intended to be placed adjacent the fume hood 10 on its own support with an electrical cable carrying instructions to the mechanism 50.

It is important that the chemical reactions so effected in chamber 22 take place in an environment in which undesirable and possibly harmful gases can be isolated from the room ambient air and be exhausted through desired ducts to a suitable venting structure. To this end, the interior of enclosure 12 is provided with an inner wall 72 juxtaposed interior of outer wall 16 to form an interior exhaust duct therebetween. Inner wall 72 includes three laterally extending exhaust ports therethrough. Top exhaust port 60, centrally disposed exhaust port 64, and bottom exhaust port 66 provide for withdrawal of gases and ambient air from chamber 22 within enclosure 12 to external duct work.

The semi-circular construction and arrangement of enclosure 12 facilitates grasping mechanism 58 reaching and grasping objects, such as test tubes, over the entire area of base 18 in chamber 22 with simple rotation of shafts 54 and radial translation of arm 56. This is with pedestal 52 centrally located on base 18, over the center of the circle described by outer circumferential wall 16.

Lighting interior of enclosure 12 in chamber 22 is provided by three recessed light fixtures 68.

In FIG. 2, enclosure 12 is a segmented structure comprising three substantially identical modules A, B and C having exposed surfaces that are abutted against one another to enclose the chamber 22 of FIG. 1. Each of modules A, B and C are three sided structures having respective circumferential outer walls 16A, 16B, and 16C; respective bases 18A, 18B and 18C; and respective top walls 20A, 20B and 20C. The outer wall of each module interconnects the top wall and base of that module. Base block 19 mounts between surfaces 23A, 23B and 23C of bases 18A, 18B and 18C.

Each module A, B, and C also has exposed surfaces corresponding to the exposed surfaces of enclosure 12 in FIG. 1. Thus, base 18A has exposed surfaces 34A and 28A, wall 16A has an exposed surface 36A and an exposed surface 30A, which cannot be seen in this Figure, and top wall 20A has exposed surfaces 32A and 38A. In a like manner module B and C each have correspondingly numbered exposed faces.

Likewise, each of the modules A, B, and C also include inner walls 72A, 72B and 72C, of which only inner wall 72B can be seen, the inner walls including the exhaust ports 60, 64 and 66, of which only exhaust ports 64B and 66B can be seen in this view. Opening 81C in top wall 20C is for withdrawal of gases and air from the module and connection to external duct work.

Modules A, B, and C, in the preferred embodiment, are generally described to be sectors of a hollow cylinder with the circumferential outer walls 16A, 16B and 16C being arcuate to define the arc of the sector. The top wall and base of each module extend inwardly from the outer wall to be in substantial coincidence respectively above and below one another, the space of opening 21, in which is mounted block 19, being excepted.

The juncture of the exposed surfaces of each top wall form an apex at the center of the circle defined by the outer wall from which they extend with the exposed surfaces thereof effectively defining the radius of the circle or sector. The exposed surfaces of the bases are like configured up to the surfaces 23A, 23B and 23C. Each of the top walls and substantially each base thus have a shape of a sector of a circle. When the three modules are arranged together with their exposed surfaces abutting one another, the enclosure 12 defines a generally hollow cylinder closed on three sides with a front sector thereof open for access by an experimenter or operator to the internally defined chamber. Thus, the experimenter sits or stands at the openings 40 and 42 and substantially within the arc defined by the outer wall 16. The experimenter, in this location, has easy access to the work surface of area of base 18, which surrounds him or her.

Alternatively, the walls 16A, 16B and 16C can be flat with the bases and top walls triangularly shaped to form a hollow rectangular or cube structure open at one side. This, however, results in a square work area, instead of a circular one, for the robotic mechanism.

In the preferred embodiment the circumferential outer walls define substantially 90° of arc so that the outer wall 16 of enclosure 12 defines substantially 270° of arc. The diameter of the enclosure 12 is defined by the length of the exposed surfaces of the top walls and bases to be as desired. The modules can be joined or fixed together in abutment with any fasteners desired.

Referring to FIG. 3, an enclosure 12' is formed by four modules A, B, C, and D that each have the specific characteristics and qualities described in connection with the modules illustrated in FIG. 2. For clarity of the drawing, the reference characters identifying the specific structure of each of the modules has not been entered. Again, each of the modules has an outer circumferential wall defining an arc of approximately 90° so that the four modules joined together with their exposed surfaces in abutment form a fully enclosed structure or enclosure 12' that substantially defines 360° of arc. In this embodiment, then there are no front panels 24 and 26 or access openings 40, 42. The enclosure 12' is closed to the atmosphere and the robotic mechanism 50 adapted to be enclosed therein has full circular access to the chamber therein.

In the embodiment of FIG. 3, access to the chamber interior of enclosure 12' is through access ports 69A, 69B (not shown), 69C and 69D covered by removable access panels 70A, 70B (not shown), 70C and 70D. These access ports and panels also exist on the modules illustrated in FIG. 2, of which only ports 69A and 69C and panels 70A and 70C can be seen.

The fume hood 10 of FIG. 1 thus can be fabricated by manufacturing a plurality of standard modules that are identical to one another and joining together a certain number of modules to obtain a desired fume hood configuration. While fume hoods having three and four modules are illustrated, it is entirely possible that a fume hood using or having only one or two modules is possible. Additionally, a rectangular fume hood can be constructed with two of the described modules arranged at its ends to form an elongated oval structure.

Each module is defined by a circumferential outer wall that is arcuate and then in the preferred embodiment defines the arc of a sector. A base and a top wall extend inwardly therefrom in coincidence above and below one another to form a three part frame. The arcuate circumferential outer wall eliminates any corners that have the juncture with the base and top wall, such corners being difficult to clean.

Figure 4:
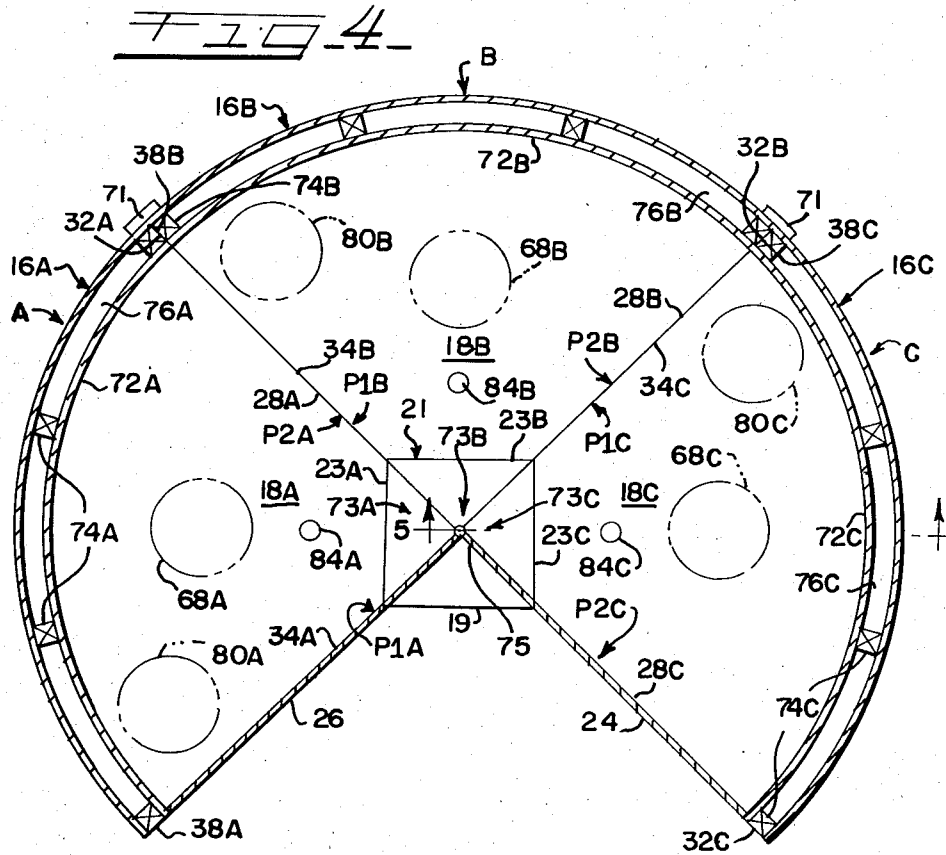
FIG. 4 is a sectional view of the fume hood taken along the line 4—4 of FIG. 1 and in the direction shown by the arrows.

In FIG. 4 the three modules A, B and C have their surfaces, no longer exposed, in abutment. In particular, surface 28A of base 18A abuts with surface 34B of base 18B and surface 32A of wall 16A abuts with surface 38B of wall 16B. Surface 28B of base 18B abuts with surface 34C of base 18C, and surface 32B of wall 16B abuts with surface 38C of wall 16C. In a like manner the surfaces of the top wall 18 also abut to join together the modules in fabricating the enclosure of the fume hood. Brackets 71 and such as screws, not shown, join together the modules. Block 19 is mounted in opening 21 defined by sides 23A, 23B and 23C by any joining means (not shown) desired.

The surfaces of each module extending from the outer wall define two planes, respectively P1A and P2A, P1B and P2B, and P1C and P2C, the planes being indicated by dashed lines over the base block 19. The intersection 75 of these planes form three apexes 73A, 73B and 73C over the top surface of block 19 and at the intersection of the surfaces of each top wall.

Figure 5:
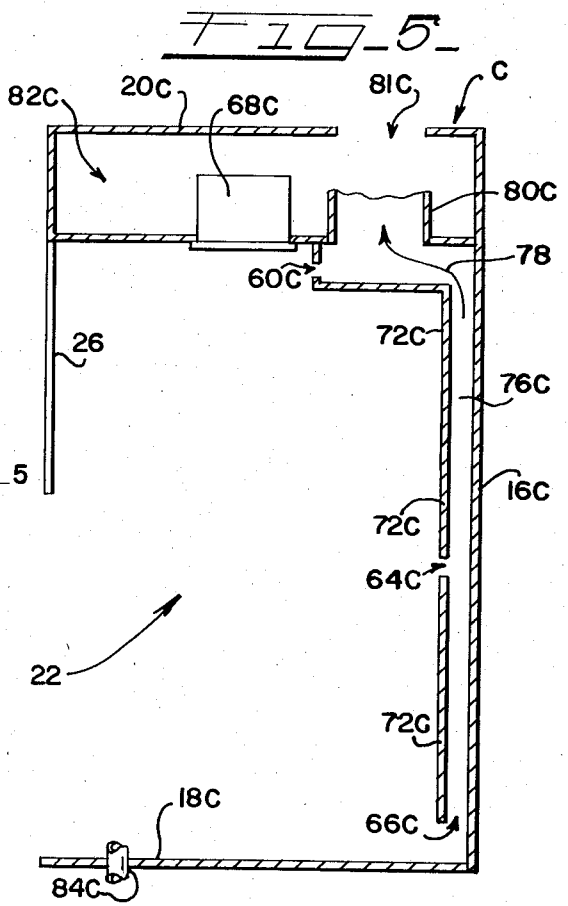
FIG. 5 is a sectional view of a module taken along the line 5—5 of FIG. 4 and in the direction shown by the arrows.

In FIGS. 4 and 5, each of the modules A, B and C have inner walls 70A, 70B and 70C that are spaced inwardly from the outer walls 16A, 16B and 16C by such as spacers 72A, 72B and 72C to define a passageway 76A, 76B and 76C therebetween. This passageway acts as a duct in combination with air movement means (not shown) to remove undesired gases and air from chamber 22. Each of the inner walls extend over the width of their respective outer walls.

In FIG. 5, access to passageway 76 for removal of air from chamber 22 is at each of the exhaust ports 60C, 64C and 66C. Withdrawal of air from passageway 76 is indicated by arrow 78 into a duct opening 80C.

Referring also to FIGS. 1 and 2 again, the exhaust ports 60, 64 and 66 extend laterally of each module at fixed, constant distances above the base 18 along the width of the outer wall 16. The exhaust ports thus can be described to be such as rectilinear slots through inner wall 72. Theses exhaust ports remove air and gases from chamber 22 with little or low turbulence from the bottom, middle and top of the chamber, and with no intruding air foils or baffles.

Referring again to FIG. 5, withdrawal of the gases and air from the duct opening 80C can be as desired. For example, the gas and air can be directed into the hollow 82C of top wall 20C and therefrom to an exterior duct work system through opening 81C in top wall 20C. Each of the modules can have separate external withdrawal duct work with each of the modules having the respective hollows in their top walls sealed from one another. Alternatively, the hollows in the top walls can be joined for communication of gas and air therein between the modules with a central connection to external duct work.

Each module also has individual recessed light fixtures such as 68C. Electrical access into chamber 22, for such as the control computer to the robotic mechanism, is provided by such as a conduit 84C through the base 18C of the module.

In FIG. 4, again, the position of conduits 84A, 84B and 84C are shown through their respective bases and the projections of the light fixtures and duct openings of each module are indicated in dashed line outline and with their respective reference characters.

In FIG. 6, an alternative embodiment front panel 86 has two hand access openings 88 therein. A pair of front panels 86, only one of which is shown, are intended to replace front panels 24 and 26 illustrated in FIGS. 1 and 2. The hand access openings 88 therein have smaller net areas for passage of air into the chamber 22 than the openings 40 and 42 presented by the front panels 24 and 26. The hand access openings 88 restrict the area through which the minimum linear rate of movement of air must be maintained to reduce the quantity of air entering the chamber 22. This decreases the total amount of air entering the chamber and the energy required to remove the undesired gases and air from the chamber 22. In the preferred embodiment, the front panels 24 and 26 and 86 are made from polycarbonate material having a thickness of approximately three-eighths of an inch.

The fume hood of the invention can be fixed in position in a laboratory or can be mobile on casters to be placed in a corner of a room or any other location. External duct work can be brought to the fume hood from a fixed location through the ceiling of the laboratory and the fan motor and blade can be mounted in the top wall of the fume hood or can be located at a fixed location external the fume hood with flexible duct work connecting the movable fume hood thereto. The diameter and height of the fume hood can be as desired. A control computer for operating a robotic mechanism contained in the fume hood can be mounted adjacent the fume hood to be mobile or fixed therewith and is connected to the fume hood by a cable passing up through such as conduit 84C.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details. Furthermore, while, generally, specific claimed details of the invention constitute important specific aspects of the invention in appropriate instances even the specific claims involved should be construed in light of the doctrine of equivalents.

We claim:

1. A fume hood for containing chemical reactions and exhausting undesired produced reaction gases and air contained therein, the fume hood comprising:

a plurality of like modules joined together in side by side abutment, each module having upstanding inner and outer back walls, a base and a top wall, the base and top wall extending inwardly from the back wall in coincidence respectively below and above one another, said inner and outer back walls defining a passageway coextensive with said outer back wall, the plurality of modules defining a chamber closed by said top walls, bases and back walls with said passageway defining exhaust means for exhausting said reaction gases and air from said chamber.

2. The fume hood of claim 1 further including a pair of front panels attached to said modules at the back walls thereof to close off said chamber.

3. The fume hood of claim 2 in which said front panels are solid sheets and each panel includes a pair of hand access openings therethrough that restrict the quantity of air entering said chamber.

4. The fume hood of claim 1 in which said inner wall is solid and includes a plurality of through exhaust ports spaced apart between said top wall and base and through which said gases and air enter said passageway.

5. The fume hood of claim 4 in which there are three exhaust ports formed by slots extending around said inner wall at certain distances from said top wall and base.

6. The fume hood of claim 1 in which the modules form a semi-cylindrical, hollow enclosure partially closing said chamber.

7. The fume hood of claim 6 in which there are three modules.

8. The fume hood of claim 1 in which the modules form a hollow, cylindrical enclosure completely closing said chamber.

9. The fume hood of claim 8 in which there are four modules.

10. The fume hood of claim 8 in which the back wall of each module includes a removable access panel for accessing said chamber.

11. The fume hood of claim 1 in which the back wall of each module defines an arc of a sector of a circle, and the top wall and base each have surfaces defining the radius of said circle so that the top wall and base both have the shape of a sector of said circle.

12. The fume hood of claim 11 in which said arc extends substantially ninety degrees.

13. A fume hood for exhausting therefrom air and undesired reaction gases produced from chemical reactions occurring therein, said fume hood comprising:

an upstanding circumferential wall having a length and a width;

a base interconnected with said circumferential wall;

a top wall interconnected with said circumferential wall;

said circumferential wall, base and top wall enclosing a chamber; and an inner wall extending the length and width of said circumferential wall and being spaced interior of said circumferential wall to define a passageway therebetween, said inner wall including at least one exhaust port providing for communication of air and said undesired reaction gases from said chamber to said passageway and said port extending across the length of said inner wall at substantially one distance from said base.

14. The fume hood of claim 13 in which there are a plurality of said exhaust ports spaced apart between said base and top wall and each exhaust port is a different distance from said base.

15. The fume hood of claim 14 in which there are three exhaust ports, one adjacent said base, one adjacent said top wall and one central exhaust port disposed centrally between said base and top wall.

16. A fume hood for exhausting therefrom air and undesired reaction gases produced from reactions occurring therein, said fume hood comprising:

at least three modules, each module having a three sided frame defining a top wall, a bottom wall and an interconnecting outer wall with the top wall and base being in substantial coincidence above and below one another, an inner wall of each module spaced interior of said outer wall of that module to define a passageway therebetween substantially coextensive with said outer wall through which said air and gases can be exhausted and said inner wall including at least one exhaust port communicating air and gases from said chamber to said passageway, each of the top wall, back wall, and base having a pair of exterior surfaces at the opposed margins thereof, each top wall having an apex at the juncture of its exterior surfaces opposite said outer wall, said exterior surfaces defining two planes extending from said outer wall to said apex, and said modules being arranged with their apexes in abutment and the exterior surfaces of adjacent planes in abutment to form a chamber closed by said frames;

a base block extending between the bases of said modules at the intersection of said planes and below said top wall apexes; and, fastener means for joining together said modules.

17. The fume hood of claim 16 in which said exhaust port extends across said inner wall at one distance from said base.

18. The fume hood of claim 16 in which said outer wall of each module is arcuate to form the arc of a sector of a circle, said apexes are at the center of said circle, said exterior surfaces of the base and top wall are the length of the radius of said circle and said base and top wall have the shape of a sector of a circle, said outer wall extending substantially ninety degrees of arc.

* * * * *